US006902377B2

(12) United States Patent
Crocker

(10) Patent No.: US 6,902,377 B2
(45) Date of Patent: Jun. 7, 2005

(54) HIGH PERFORMANCE AXIAL FAN

(75) Inventor: Michael T. Crocker, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 22 days.

(21) Appl. No.: 10/420,116

(22) Filed: Apr. 21, 2003

(65) Prior Publication Data

US 2004/0208746 A1 Oct. 21, 2004

(51) Int. Cl.[7] ..... F04D 29/38
(52) U.S. Cl. ..... 416/223 R; 416/234; 416/243
(58) Field of Search ..... 416/234, 238, 416/243, 169 A, DIG. 5, 223 R, 196 A

(56) References Cited

U.S. PATENT DOCUMENTS

| | | | | |
|---|---|---|---|---|
| 2,524,870 A | * | 10/1950 | Adamtchik | 416/243 |
| 4,219,325 A | * | 8/1980 | Gutzwiller | 432/199 |
| 5,620,306 A | * | 4/1997 | Day | 416/185 |
| 5,769,607 A | * | 6/1998 | Neely et al. | 416/189 |
| 6,086,330 A | * | 7/2000 | Press et al. | 416/223 R |
| 6,206,641 B1 | * | 3/2001 | Park et al. | 416/182 |
| 6,293,753 B1 | * | 9/2001 | Pal et al. | 415/221 |
| 6,386,830 B1 | | 5/2002 | Slipper et al. | |

FOREIGN PATENT DOCUMENTS

| | | |
|---|---|---|
| GB | 322840 | 12/1929 |
| JP | 2001115993 | 4/2001 |

OTHER PUBLICATIONS

Johnson Pat, "Intel Thermal Reference Design: High–Performance Air Cooled Desktop Solution," Proceedings of the Intel Developer Forum 2003, Sep. 18, 2003, retrieved from the Internet on Jan. 13, 2005: <URL: http://www.intel.com/idf/us/fall2003/presentations/FQ3USDSIS87_OS.pdf>.

* cited by examiner

*Primary Examiner*—Ninh H. Nguyen
(74) *Attorney, Agent, or Firm*—Carrie A. Boone P.C.

(57) ABSTRACT

A fan impeller is part of a fan assembly designed to maximize both intake and expelled air during use. The fan impeller employs a distinct airfoil shape for the fan blades to substantially move the ambient air. A low constant blade angle and overlapping blades are employed to improve the blade lift and consequent mass flow and exit pressure. The blade stall is eliminated, as evidenced by a smoothened fan curve, for more efficient operation. The blade sweep angle is optimally arranged to control radial flow characteristics of the ambient air. Housing sidewalls are removed from the fan assembly to remove parasitic drag and improve the motion of air passing through the fan.

15 Claims, 6 Drawing Sheets

HIGH PERFORMANCE AXIAL FAN

FIELD OF THE INVENTION

This invention relates to cooling fans for use in electronic cooling environments and, more particularly, to a high-performance fan with no intake restriction.

BACKGROUND OF THE INVENTION

A fan is an air pump, powered by a motor, which produces a volumetric flow of air at a certain pressure. The rotating portion of the fan, known as an impeller, comprises a hub with radiating blades that converts torque from the motor to increase static pressure across the hub. The increased static pressure increases the kinetic energy of the air particles, causing them to move. Fans are thus useful for air movement and ventilation.

Fans come in many forms. Axial fans include impellers that rotate to move large amounts of air at low pressure. The air moves in a direction parallel to the fan blade axis. Axial fans can produce a high rate of airflow and are inexpensive to produce, but are useful only in low-pressure environments. Further, axial fans are noisy when the ambient conditions are unfavorable, such as when there is insufficient air or when the airflow is blocked, such as in ductwork.

Centrifugal fans, also known,as blowers, also include rotating plates with radially extending blades, but blowers use centrifugal force to move the air. Airflow from the blower tends to be perpendicular to the blade axis, and at a lower flow rate than with axial fans. Centrifugal fans are more expensive to produce than axial fans and can generally operate at about four times the pressure of axial fans.

Although fans come in many varieties, higher-quality fans tend to operate more quietly and more efficiently. A good quality fan may include ball bearings for smoother operation of the impeller, and preferably has a snug fit between the blades and the fan housing, to ensure that leakage does not occur during operation. Care in manufacture, such as guaranteeing that each blade matches in size, weight, and configuration, may also improve fan efficiency.

The amount of airflow delivered by the fan is related to the fan's construction and placement. The number and length of the fan blades are important, as well as the distance of the fan from other objects and the speed of the fan motor. Ultimately, though the fan efficiency is determined by the design and arrangement of the fan blades.

Processor-based systems, such as desktop computers, generate a substantial amount of heat. These systems often include fans for the power supply, the hard disk drive, and one or more heat sinks placed on the heat-producing microprocessor. Surprisingly, little attention is paid to the design of the fan blades for these uses. The limitation in air intake within the processor-based system, as well as the increasing demand for more effective heat sinks makes the design of a fan in such systems of paramount concern.

Thus, there is a need for a fan assembly wherein the volume of air available for intake into the fan as well as the amount expelled from the fan is maximized.

DETAILED DESCRIPTION

In accordance with some embodiments described herein, a fan impeller is disclosed for maximizing both intake and expelled air during use. The impeller utilizes airfoil shapes to efficiently impart momentum to the surrounding air. The air expelled from fans using the disclosed impeller is at a higher pressure than can be delivered by comparably sized prior art fans.

The fan impeller employs a distinct airfoil shape for the fan blades to substantially move the ambient air. The use of airfoil-shaped as well as overlapping blades improve the blade lift and consequent mass flow and exit pressure. The blade stall is eliminated, as is evident in a smoother fan curve for the fan impeller relative to prior art fans. The blade sweep angle is optimally arranged to control the radial flow characteristics of the ambient air. Housing sidewalls are removed from the fan assembly to remove parasitic drag and improve the motion of air passing through the fan.

In the following detailed description, reference is made to the accompanying drawings, which show by way of illustration specific embodiments in which the invention may be practiced. However, it is to be understood that other embodiments will become apparent to those of ordinary skill in the art upon reading this disclosure. The following detailed description is, therefore, not to be construed in a limiting sense, as the scope of the present invention is defined by the claims.

Figure 1:
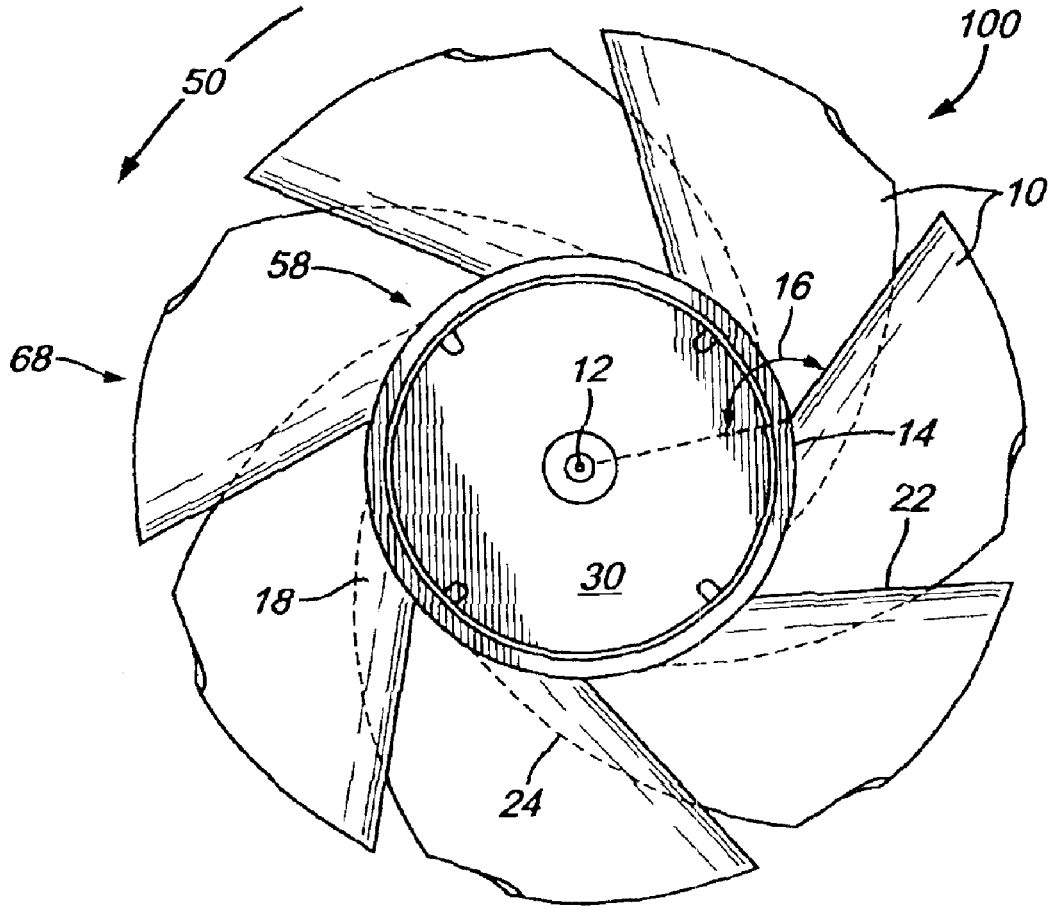
FIG. 1 is a top view of a fan impeller according to some embodiments of the invention.
Figure 2:
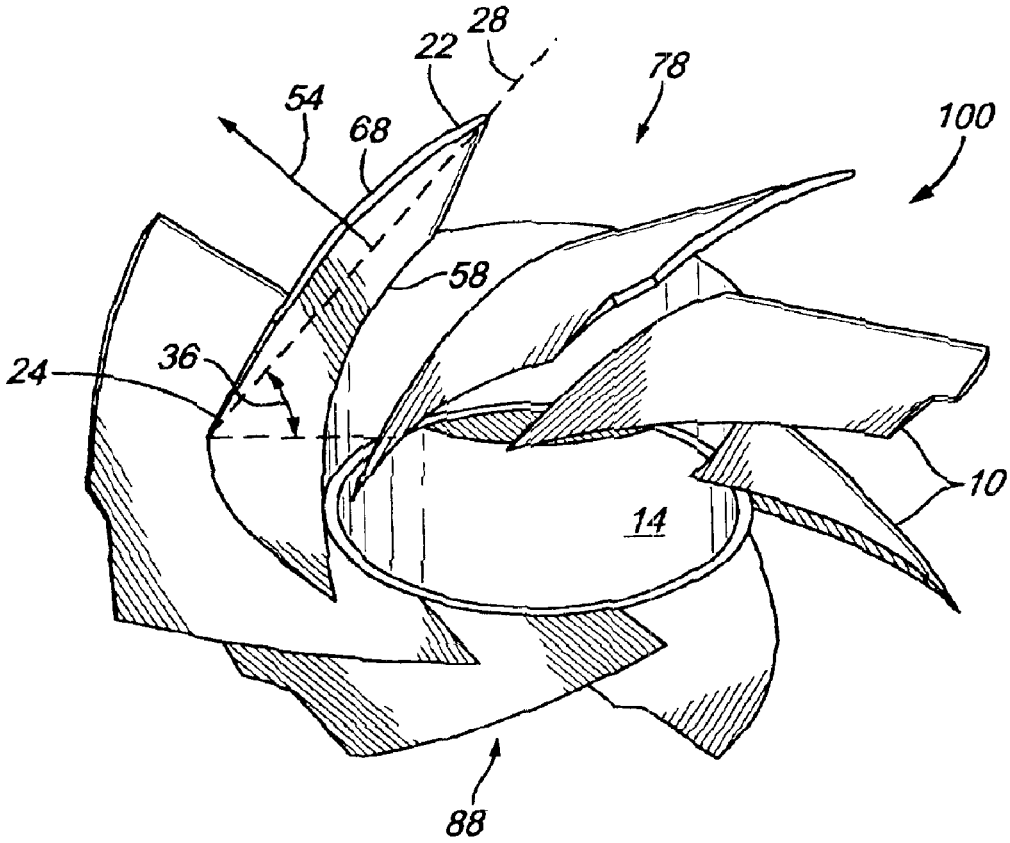
FIG. 2 is an isometric view of the fan impeller of FIG. 1.

In FIGS. 1 and 2, top and isometric views, respectively, of a fan impeller 100 are shown. The impeller 100 includes a plurality of blades 10 arranged around a hub 14. Otherwise hidden edges of the blades 10 in the image of FIG. 1 are made visible, for a more precise understanding of the blade arrangement.

The hub 14 of the impeller 100 is a cylindrical body to which the blades 10 are connected. The part of the blade that is closest to the hub, known as the blade root 58, extends across the cylindrical walls of the hub 14. (The part of the blade farthest from the hub is known as the blade tip 68.) As shown in FIG. 2, the blade root 58 overlaps the bottom of the hub 14.

The hub 14 is closed off at one end by a cover 30, a flat, circular plate, that connects transverse to the top of the hub. A blade axle 12, disposed at the center of the cover 30, may be a rigid rod positioned orthogonal to the cover 30. Upon turning the blade axle 12, the fan impeller 100 rotates. Typically, the blade axle is powered by a motor (not shown).

The blades 10 have a leading edge 22, a trailing edge 24, an overlapping portion 18, and a blade sweep angle 16. The leading edge 22 is the portion of the blade that first makes contact with the ambient air, at a front intake area 78. The trailing edge 24 is the portion that last makes contact with the ambient air, at a rear discharge area 88.

Blade Geometry

The fan impeller 100 is designed for more efficient operation than typical fan impellers. The blade geometry is optimized to perform at a predetermined speed, or revolutions per minute (RPM) range. The blade sweep angle is optimally arranged to control radial flow characteristics of the ambient air. The airfoil design and the angle of the blades 10, or blade angle, are designed for optimal performance of the fan impeller 100 at a specified operating condition.

Varying Cross-sectional Thickness

In contrast to typical fan impellers, in which the blades are of uniform thickness throughout, the blades 10 of the fan impeller 100 have varying cross-sectional thickness. In particular, a cross-section of the blades 10 reveals that the blades 10 are airfoil-shaped. An airfoil is a surface designed so that air flowing around it produces useful motion. Usually describing a cross-section of an airplane wing, airfoils are generally designed to produce lift. More broadly, airfoils are useful for efficiently controlling the flow of air around them. The shape of the airfoil affects the speed of air flowing both over and under the airfoil. Airfoil-shaped blades minimize airflow turbulence, maximize useful angles of attack, and reduce sound level problems. Airfoil properties are discussed in more detail, below.

Smooth Leading Edges

In addition to their airfoil shape, the blades 10 have rounded or smooth leading edges 22. The smooth leading edges reduce blade drag, which improves the efficiency of the impeller 100. Further, impeller blades with smooth leading edges tend to produce less noise than those without such a feature.

Concave Blades

The blades 10 of the fan impeller 100 are concave, when viewed from the leading edge 22, to draw air toward the inside of the fan impeller. The cup shape of the blades provides a scooping effect, for improving the intake volume of air, which is pulled in radially as well as axially. The greater volume from which air can be drawn results in a relatively greater expelled volume by the impeller 100, as compared to typical fan impellers.

Looking at FIG. 1, the intake air is described as axial where the air is received into the fan impeller 100 from behind. The intake air is described as radial where the air is received into the fan impeller from the sides. The fan impeller 100 utilizes both axial and radial intake air during operation.

Constant Blade Angle

The blades 10 have a constant or nearly constant blade angle. The blade angle is measured by connecting a line between the leading edge and the trailing edge of the blade (known as the chord), where that line then intersects with a horizontal plane when the hub 14 is disposed horizontally. (Blade angle 36 is shown in FIG. 2). In some prior art fan impellers, the blade angle varies in the radial direction, from root to tip, possibly to simplify manufacture and/or to produce uniform axial flow. The blade may twist, from root to tip, such that the blade angle at the tip is different from the blade angle at the root. In contrast, the blade angle of the fan impeller 100 at the blade root 58 and at the blade tip 68 are substantially similar to one another, or substantially constant. Put another way, the blades 10 of the fan impeller 100 do not twist from the root 58 to the tip 68.

Trailing Edge 50% Longer than Leading Edge

The constancy of the blade angle 36, from root to tip, results in a trailing edge 24 that is approximately fifty percent longer than the leading edge 22. This substantially increases the blade area, which allows the fan impeller 100 to operate with increased lift, higher mass flow, and higher exit pressure.

Low Blade Angle

Furthermore, the blade angle 52 is low, relative to prior art fan impellers. The blade angle 52 may fall between 20 and 50 degrees, preferably between 30 and 40 degrees. In some embodiments, the blade angle 52 is 40 degrees. In some other embodiments, the blade angle 52 is 30 degrees.

Overlapping Blades

In the fan impeller 100, the blade surfaces are overlapping, when viewing the fan impeller in the direction of the blade axle 12, such as in FIG. 1. Prior art fan impellers are generally designed such that the blades do not overlap when viewed from the blade axis 12. This allows the impeller 100 to be pulled axially during manufacture (typically by plastic injection molding), simplifying the injection mold tool. The presence of blade overlap in the impeller 100 allows for constant blade angles and increases the blade surface area, at the cost of a slightly more complex plastic injection tool.

Blade Sweep Angle

In addition to having an overlapping portion 18, in which the leading edge 22 of one blade overlaps the trailing edge 24 of an adjacent blade, the blade sweep angle 16 of the blades 10 may vary.

In the top view of FIG. 1, for a given blade 10, the blade tip 68 leads, or precedes, the blade root 58, going in the direction of rotation 50. Thus, the blade 10 is "forward swept." The blade sweep angle 16 is greater than 90°, but less than 180°. The triangular shape of the forward sweep emphasizes the blade tip 68, resulting in a more even overall intake of air volume, and thus, less turbulent operation of the fan impeller 100.

Alternatively, the blades 10 may be positioned such that there is no forward sweep. In other words, the blade tip 68 does not precede the blade root 58, going in the direction of rotation 50. Rather, the leading edge 22 extends substantially perpendicular from the hub 14, such that the blade sweep angle 16 is approximately 90°. In such a configuration, the blade 10 is said to have "no sweep."

As a further alternative, the blades 10 may be positioned such that the blade root 58 precedes the blade tip 68, going in the direction of rotation 50. The blade sweep angle 16 is greater than 180°, but less than 135°. The blade 10 is thus "backward swept." The fan impeller 100 blades may be forward swept, backward swept, or may include no sweep, as indicated by the blade sweep angle 16.

Airfoil Properties

Figure 3A:
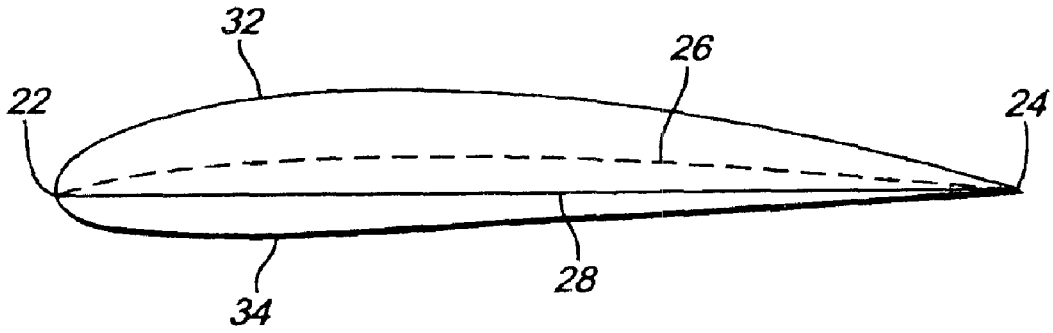
FIGURE 3A (Prior Art)
FIGS. 3A and 3B are diagrams of airfoils according to the prior art.
Figure 3B:
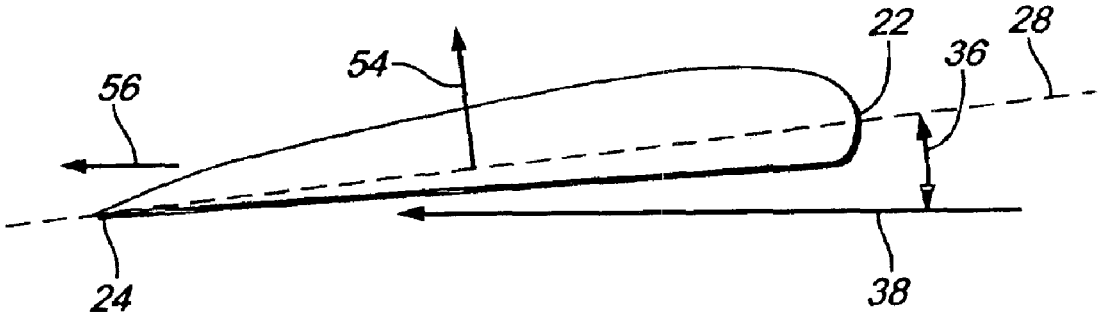
FIGURE 3B (Prior Art)

As previously indicated, the blades 10 of the fan impeller 100 are airfoils. Airfoils 20A and 20B are depicted in FIGS. 3A and 3B, respectively. Several features useful for discussing airfoils are illustrated: the leading edge 22 and the trailing edge 24, already shown in the fan impeller 100, a camber line 26, a chord 28, and a blade angle 36. The leading edge 22 of the airfoil 20 is the portion that first makes contact with the surrounding air. The trailing edge 24 is the point at which airflow passing over the upper surface 32 meets with airflow passing over the lower surface 34 of the airfoil 20. The chord 28 is an imaginary straight line drawn through the airfoil between the leading edge 22 and the trailing edge 24. The camber line 26 follows the midpoint between the upper surface 32 and the lower surface 34. As shown in FIG. 3B, the blade angle 36 is formed by the intersection of the chord 28 and an imaginary horizontal plane 38.

Lift 54 by the blade 10 is generated normal to the blade chord 28. The lift force is an airfoil characteristic that is preferably increased for efficient impeller design. Lift 54 and drag 56 characteristics are largely dependent upon the airfoil shape and the blade angle 36. The fan impeller 100 balances against an increase in backpressure or impedance by increasing the blade angle 36. An increase in the blade angle 36 increases the lift force 54, up to the point of blade stall, where the lift force decreases. In some embodiments, an optimal blade angle is achieved with the fan impeller 100, such that stall (from too steep a blade angle) and ineffective lift (from too small a blade angle) are avoided.

The National Advisory Committee for Aeronautics (NACA) once maintained as classified a collection of airfoil geometries to be used for aeronautical development and other engineering analysis. (Created in 1915, the National Advisory Committee for Aeronautics operated as an agency of the United Stated Department of Defense until 1958.) Each NACA airfoil is generated by polynomials that represent the shape of the camber line and the thickness of the airfoil.

Figure 4A:
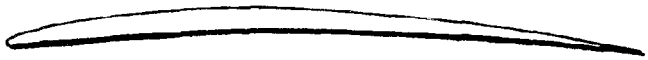
FIGURE 4A (Prior Art)
FIGS. 4A–4C are diagrams of NACA airfoils according to the prior art.
Figure 4B:
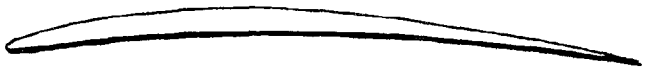
FIGURE 4B (Prior Art)
Figure 4C:
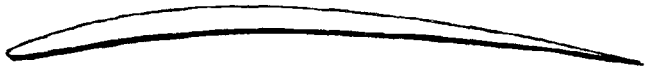
FIGURE 4C (Prior Art)

In FIGS. 4A–4C, three airfoils, NACA 5404, NACA 6404, and NACA 7404, respectively, are depicted. A numbering system is used to classify each airfoil. In a four-digit airfoil, the first (left-most digit) number indicates the amount of bow in the camber line (as a percentage of the airfoil chord). The second number, adjacent to the first, indicates the location of the highest point in the bow as a percentage of the chord. The rightmost two digits indicate the amount of thickness to be added to the camber line as a percentage of the airfoil chord.

For the fan impeller 100, the airfoil geometry, coefficients of lift, coefficients of drag, and pressure distribution of the blades are based on infinite length straight wings. Using one of the NACA geometries described, such as in FIGS. 4A–4C, the blades 10 of the fan impeller 100 maintain stream-wise airflow relationships that ensure predictable airfoil performance for a radial configuration, according to some embodiments.

Elimination of Blade Stall

The blade features described above are designed for efficient operation of the fan impeller 100. Additionally, a condition known as blade stall is minimized or eliminated in the fan impeller 100. As backpressure or impedance is increased, the impeller balances against the impedance by increasing the angle of attack and, hence, increasing the lift force. At some impedance, however, the airfoil is unable to increase the lift, leading to flow separation.

To counter this effect, the blade angle is kept small in the impeller 100, such that flow separation (or blade stall) is minimized or eliminated. Flow separation is a phenomenon that occurs when the airflow no longer follows the contour of the blade surface. The small blade angle allows the entire blade area to be utilized for lift, resulting in a substantially higher performing impeller and reduced noise generation, in some embodiments.

A "knee" in the fan curve of most fan impellers is the flow separation (or blade stall) point. As will be shown, below, the fan impeller 100 has no knee in its fan curve. Instead, the impeller 100 transitions smoothly from operating primarily from its airfoil lift characteristics to a simpler swirl scheme, for more efficient operation.

Fan Curve

Figure 5:
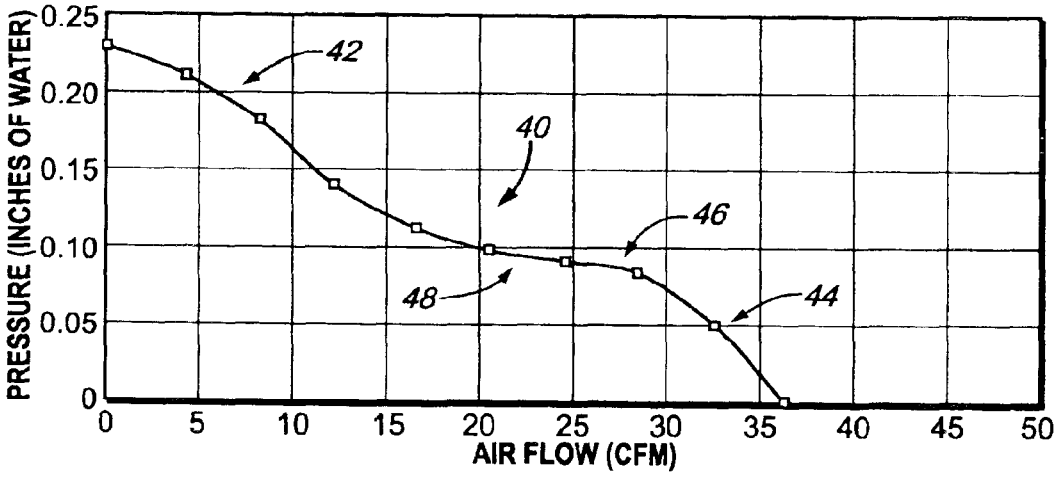
FIGURE 5 (Prior Art)
FIG. 5 is a graph of a fan curve according to the prior art.

FIG. 5 is a graph of a fan curve 40 for a typical prior art fan impeller. The fan curve 40 depicts airflow versus static pressure. A fan can deliver one quantity of airflow and one pressure in a given environment. Accordingly, at a relatively higher pressure, the prior art impeller delivers a relatively lower airflow, as shown in FIG. 5. This is depicted as the swirl-dominant region 42 of the fan curve 40. When the fan impeller operates in the swirl-dominant region 42, the axial airflow is reduced by the back pressure while the rotational velocity of the fan is essentially unchanged. This results in air exiting the fan with a relatively higher swirl velocity and lower axial velocity.

The fan curve graph 40 also includes an airfoil-dominant region 44. The airfoil-dominant region is the part of the fan curve 40 where the pressure is relatively low and the airflow is relatively high. When the impeller operates in the airfoil-dominant region 44, the airflow is governed by the airfoil characteristics at that particular velocity. Typically, the impeller will operate somewhere between the swirl-dominant region 42 and the airfoil-dominant region 44, shown in FIG. 5 as the transition region 48.

The fan curve 40 includes a knee 46 in the transition region 48, at which point the relative airflow begins to drop, despite a drop in pressure. The knee 46 is the point at which many prior art fans become inefficient, as the fan speed (RPM) increases with little or no increase in pressure and a substantial loss in airflow.

Figure 6:
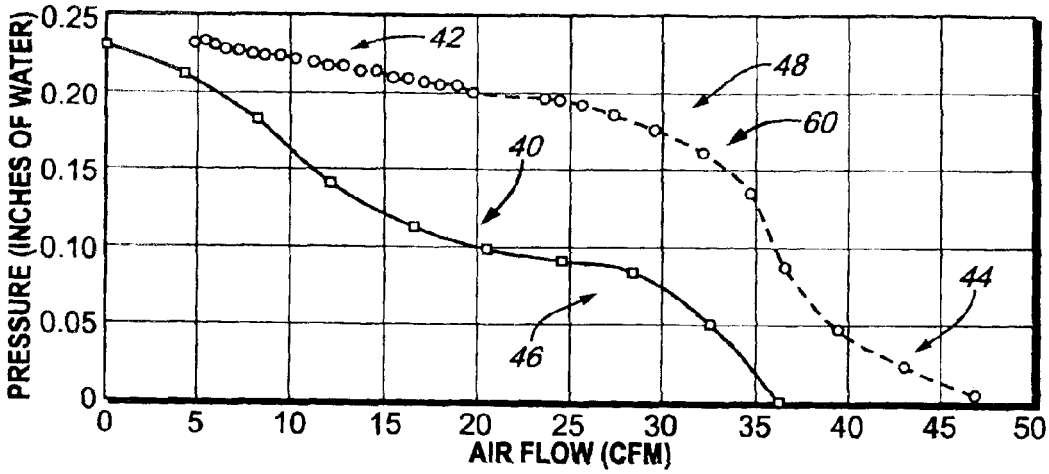
FIG. 6 is a comparison graph of fan curves for both the fan impeller of FIG. 1 and a prior art fan.

The fan impeller 100 is designed with the inefficiencies of prior art fans in mind. The use of high-lift airfoil shapes in a curved and overlapping blade profile, the smooth leading edges 22, and the blade position along the hub contribute to the success of the fan impeller 100, as illustrated in the fan curve 60 of FIG. 6.

In contrast to the prior art fan impeller curve 40, the fan curve 60 for the impeller 100 provides a consistently higher airflow rate all along the curve. Further, the fan curve 60 has no visible knee, or increase in airflow without a corresponding decrease in static pressure, in the transition area between the swirl-dominant 42 and airfoil-dominant 44 regimes. In contrast, the knee 46 in the prior art fan curve 40 is evident. A significant improvement in impeller performance can be observed in the transition region 48 of the fan curve 60, which is where fan impellers typically operate.

Figure 7:
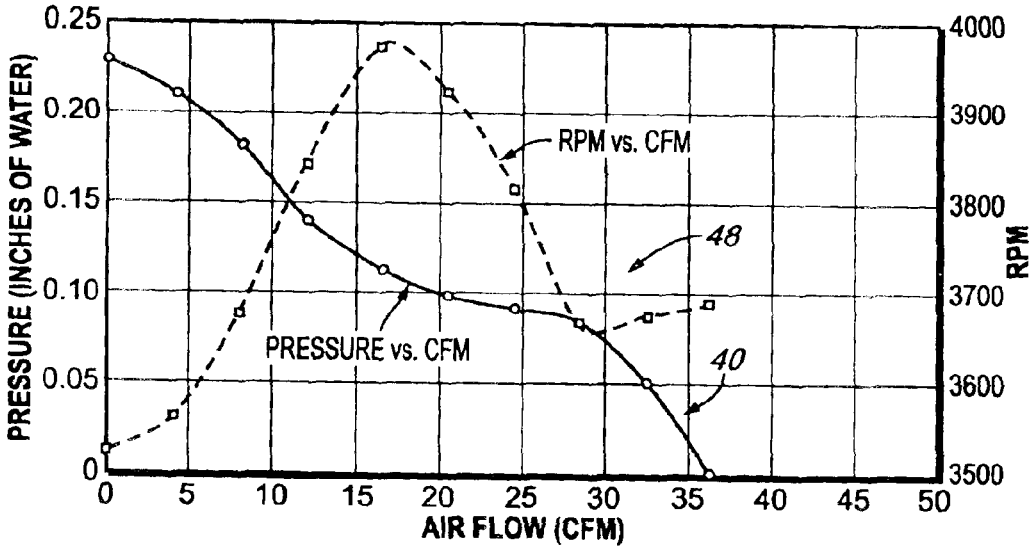
FIGURE 7 (Prior Art)
FIG. 7 is an RPM vs. CFM graph superimposed on the prior art fan curve of FIG. 4 according to the prior art.

In FIG. 7, the flow separation of a typical prior art fan is illustrated. The graph depicts revolutions per minute versus cubic feet per minute (RPM vs. CFM), overlaid on the fan curve 40. At the knee 46 of the fan curve 40, the speed (RPM) increases significantly with little increase in pressure and a great loss in airflow.

Figure 8:
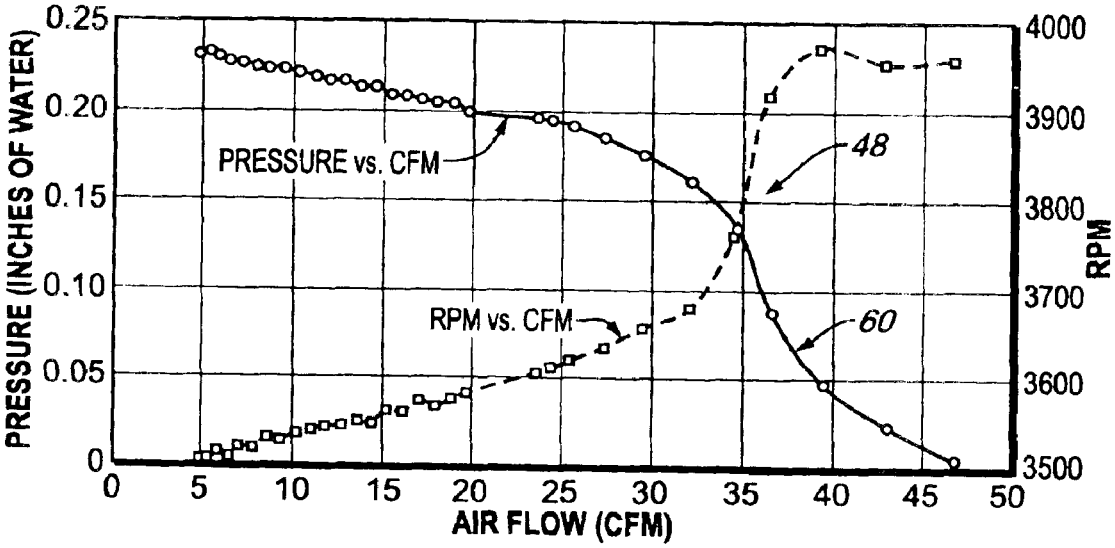
FIG. 8 is an RPM vs. CFM graph superimposed on the fan curve for the fan impeller of FIG. 1.

The opposite effect can be seen with the fan impeller 100, as illustrated in FIG. 8. At the point in the graph where the transition occurs, the speed (RPM) rises less significantly. The speed then decreases as the fan impeller 100 continues to work against increasing impedance. The fan impeller 100 is able to work against the further increasing impedance by transitioning from an airfoil-dominant operation to a swirl-dominant operation.

No Housing Sidewall

The fan impeller 100 includes no housing sidewall. Prior art fan impellers typically have a housing that surrounds the blades and provides mechanical structure to the fan. The elimination of the fan housing sidewall ensures that the radial inlet flow path is available in addition to the axial inlet flow path. The availability of both axial inlet flow and radial inlet flow allows a smoother transition from airfoil-dominant to swirl-dominant behavior.

The radial inlet air travels a greater distance across the blades 10 than is typical for an axial inlet fan impeller. In the fan impeller 100, the inlet air crosses the blades 10 along a diagonal. This reduces the pressure gradient (i.e., the same change in airflow momentum from inlet to exit occurs, but is applied across an increased length), which delays flow separation.

Further, eliminating the housing sidewalls removes any potential parasitic drag that the fan blades may encounter, due to the boundary layer on the sidewalls. This boundary layer will also impede the motion of air passing through the fan.

Figure 9:
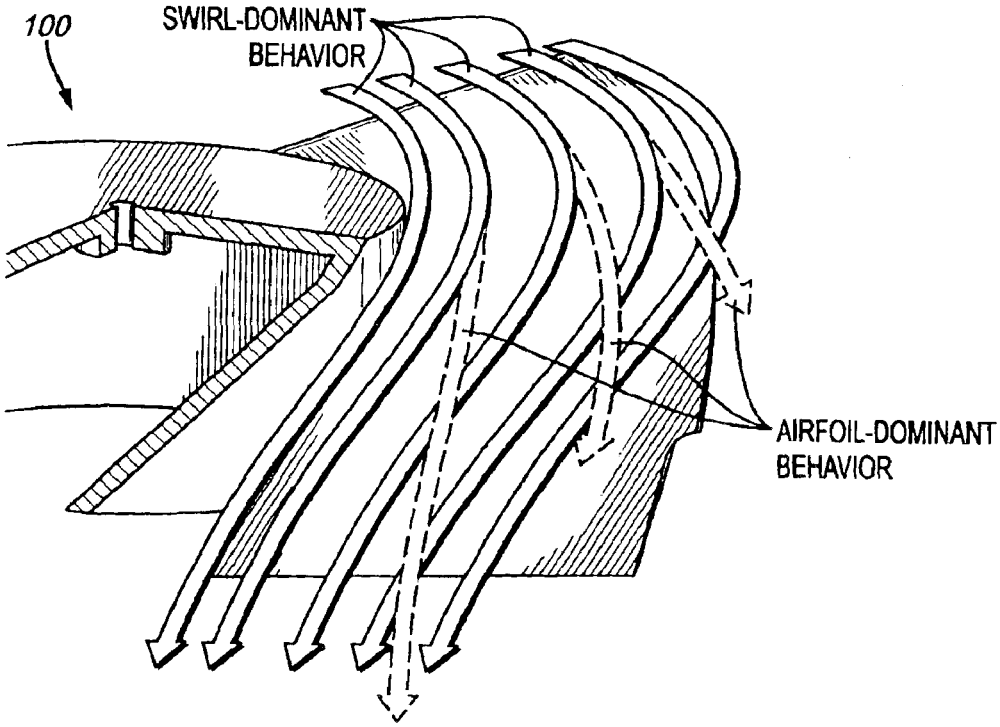
FIG. 9 is an isometric view of the fan impeller of FIG. 1, including axial and centrifugal airflow lines.

In FIG. 9, an isometric view of the fan impeller 100 shows the mid-plane of the impeller gap. Solid arrows show the swirl-dominant behavior of the impeller 100 while dashed arrows show the airfoil-dominant behavior.

Operating Environment

In some embodiments, the fan impeller 100 is used in conjunction with a heat sink assembly to transfer heat from a microprocessor or other heat-producing semiconductor device in a processor-based system. Heat sinks often employ fans to increase ambient airflow around the heat sink and the microprocessor. The fan replaces air recently heated by the heat sink assembly with cooler ambient air. The fan, therefore, generally improves the efficiency of the heat sink.

Typically, fans used in computing environments, such as those used with heat sinks, power supplies, and hard disk drives, are designed without considering the airfoil properties of the fan blades. This ignorance leads to fan designs that are highly inefficient and noisy. Instead, considerations such as simplifying the manufacture and minimizing the number of moving parts generally influence fan design in such systems. The lack of blade design consideration leads to highly inefficient fan operation. Where the inefficiently designed fan is coupled with a heat sink, the rating of the heat sink design is ultimately limited.

The attention to the blade geometry, as well as airfoil principles, makes the fan impeller 100 a preferred choice for use in conjunction with heat sinks. The fan impeller 100 may also be used in other electronic cooling environments, such as with power supplies or other heat-producing electronic equipment. The fan impeller 100 can also be part of an industrial environment, such as a factory or manufacturing facility.

While the invention has been described with respect to a limited number of embodiments, those skilled in the art will appreciate numerous modifications and variations therefrom. It is intended that the appended claims cover all such modifications and variations as fall within the true spirit and scope of the invention.

I claim:

1. A fan impeller, comprising:

a cylindrical hub; and a blade integrally coupled to and extending from the hub, the blade comprising an airfoil-shaped cross-section, a rounded leading edge, and a trailing edge, the leading edge overlapping an adjacent blade trailing edge, wherein the trailing edge is approximately fifty percent longer than the leading edge.

2. The fan impeller of claim 1, wherein the blade further has a substantially constant blade angle.

3. The fan impeller of claim 2, wherein the blade angle is between twenty and fifty degrees.

4. The fan impeller of claim 3, wherein the blade angle is forty degrees.

5. The fan impeller of claim 3, wherein the blade angle is thirty degrees.

6. A fan impeller, comprising:

a cylindrical hub; and a blade connected to the hub, the blade comprising an airfoil cross-section, a leading edge, and a trailing edge, wherein the leading edge is smooth and the trailing edge is approximately fifty percent longer than the leading edge;

wherein the fan impeller transitions from swirl-dominant to airfoil-dominant behavior without blade stall.

7. The fan impeller of claim 6, wherein the blade comprises a substantially constant blade angle from blade root to blade tip.

8. The fan impeller of claim 7, wherein the blade angle is approximately between twenty and fifty degrees.

9. The fan impeller of claim 8, wherein the blade angle is approximately forty degrees.

10. The fan impeller of claim 8, wherein the blade angle is approximately thirty degrees.

11. The fan impeller of claim 6, wherein the impeller receives inlet air bath axially and radially.

12. The fan impeller of claim 6, further comprising a blade axis and a second blade, wherein the second blade overlaps the blade, when viewed in the direction of the blade axle.

13. The fan impeller of claim 6, wherein the blade is forward swept.

14. The fan impeller of claim 6, wherein the blade has no sweep.

15. The fan impeller of claim 6, wherein the blade is backward swept.

* * * * *